US009198481B2

(12) United States Patent
Hortnagl

(10) Patent No.: US 9,198,481 B2
(45) Date of Patent: Dec. 1, 2015

(54) BUCKLE

(75) Inventor: Andreas Hortnagl, Fulpmes (AT)

(73) Assignee: ABA Hörtnagl GmbH, Fulpmes (AT)

( * ) Notice: Subject to any disclaimer, the term of this patent is extended or adjusted under 35 U.S.C. 154(b) by 291 days.

(21) Appl. No.: 13/879,469

(22) PCT Filed: Oct. 7, 2011

(86) PCT No.: PCT/AT2011/000420

§ 371 (c)(1),
(2), (4) Date: Apr. 15, 2013

(87) PCT Pub. No.: WO2012/048356

PCT Pub. Date: Apr. 19, 2012

(65) Prior Publication Data

US 2013/0192033 A1 Aug. 1, 2013

(30) Foreign Application Priority Data

Oct. 14, 2010 (AT) ..... A 1703/2010

(51) Int. Cl.
*A44B 11/25* (2006.01)
*A44B 11/26* (2006.01)

(52) U.S. Cl.
CPC ..... *A44B 11/2592* (2013.01); *A44B 11/2519* (2013.01); *A44B 11/266* (2013.01); *Y10T 24/45524* (2015.01); *Y10T 24/45581* (2015.01); *Y10T 24/45623* (2015.01)

(58) Field of Classification Search
CPC ..... A44B 11/2592; A44B 11/2519; A44B 11/266; Y10T 24/45623; Y10T 24/45534; Y10T 24/45529; Y10T 24/45524; Y10T 24/45613; Y10T 24/45628; Y10T 24/45487; Y10T 24/45581; Y10T 24/45618; Y10T 24/45607; Y10T 24/45602
USPC ..... 24/614, 615, 616, 629, 630, 631, 632, 24/634, 607, 625
See application file for complete search history.

(56) References Cited

U.S. PATENT DOCUMENTS

| | | | | |
|---|---|---|---|---|
| 4,912,950 | A * | 4/1990 | Crowle | 24/614 |
| 5,144,725 | A | 9/1992 | Krauss | |
| 5,311,649 | A * | 5/1994 | Suh | 24/616 |
| 5,383,257 | A | 1/1995 | Krauss | |
| 5,419,020 | A * | 5/1995 | Murai | 24/625 |

(Continued)

FOREIGN PATENT DOCUMENTS

| | | |
|---|---|---|
| CN | 201445021 | 5/2010 |
| CN | 201541856 | 8/2010 |

(Continued)

*Primary Examiner* — Robert J Sandy
(74) *Attorney, Agent, or Firm* — Volpe and Koenig, P.C.

(57) ABSTRACT

A buckle (1) having a first buckle part (2) and having at least one second buckle part (3), said first buckle part (2) having at least one locking bar (4) that can be moved back and forth between a locking position of the locking bar (4) and an unlocking position of the locking bar (4). The locking bar (4) engages behind a locking surface (5) of the second buckle part (3) in the locking position in order to lock the two buckle parts (2, 3) with each other in a connected position of the buckle parts (2, 3), and the locking bar (4) can be moved into the unlocking position in order to separate the buckle parts (2, 3), the second buckle part (3) having at least one counter locking bar (6) that can be moved back and forth between a locking position of the counter locking bar (6) and an unlocking position of the counter locking bar (6).

10 Claims, 4 Drawing Sheets

(56) References Cited

U.S. PATENT DOCUMENTS

| | | | | |
|---|---|---|---|---|
| 5,517,836 | A * | 5/1996 | Hong | 70/30 |
| 5,548,879 | A * | 8/1996 | Wu | 24/625 |
| 5,845,376 | A | 12/1998 | Tung | |
| 6,145,172 | A | 11/2000 | Bourdon | |
| 6,487,761 | B2 | 12/2002 | Van Tassel | |
| 6,560,830 | B1 | 5/2003 | Chi | |
| 7,681,288 | B1 * | 3/2010 | Giampavolo | 24/615 |
| 8,196,273 | B2 | 6/2012 | Anscher | |
| 2002/0092140 | A1 | 7/2002 | Van Tassel | |
| 2003/0074772 | A1 | 4/2003 | Chen | |
| 2004/0112098 | A1 * | 6/2004 | Bonelli et al. | 70/58 |
| 2007/0266746 | A1 | 11/2007 | Yu | |
| 2009/0100652 | A1 | 4/2009 | Mok | |
| 2010/0243373 | A1 * | 9/2010 | Johnson et al. | 24/171 |
| 2010/0313392 | A1 | 12/2010 | Anscher | |
| 2011/0107565 | A1 * | 5/2011 | Shen | 24/633 |
| 2011/0107656 | A1 | 5/2011 | Miller | |
| 2014/0304955 | A1 * | 10/2014 | Hortnagl | 24/595.1 |

FOREIGN PATENT DOCUMENTS

| | | |
|---|---|---|
| DE | 4314014 | 8/1994 |
| DE | 102007058124 | 6/2009 |
| EP | 0446766 | 9/1991 |
| EP | 0607576 | 7/1994 |
| EP | 2316295 | 5/2011 |
| WO | DM/045484 | 10/1998 |
| WO | 2009143410 | 11/2009 |
| WO | 2009143464 | 11/2009 |
| WO | 2010082972 | 7/2010 |
| WO | 2012162711 | 12/2012 |

* cited by examiner

BUCKLE

BACKGROUND

The present invention relates to a buckle having a first buckle part and having at least one second buckle part, wherein the first buckle part has at least one locking bar which is movable back and forth between a locking position of the locking bar and an unlocking position of the locking bar, wherein in a connecting position of the buckle parts the locking bar, in its locking position, engages behind a locking face of the second buckle part for locking the two buckle parts together and the locking bar is movable into its unlocking position for separating the buckle parts.

Nowadays a plurality of developments of buckles of the noted type are known. An example of generic buckles is shown, for example, in international pattern and design DM/045 484. Generic buckles are used in the most varied areas of use, in particular when two belts or bands have to be releasably connected together. Examples of areas of application are mountain sports, safety at work, etc.

In some of said areas of use, the buckles have to be operable on the one hand in a simple manner and using as little force as possible in order to separate the buckle parts from one another. On the other hand, however, when they are in the connecting position and in the locking position too, the buckles have to withstand large tensile loads. Unwanted or accidental opening of the connection between the buckle parts or opening brought about by overloading is to be avoided unreservedly in many areas of use.

SUMMARY

It is the object of the invention to provide a buckle of the abovementioned type which, in this sense, is as simple as possible to operate but at the same time is very operationally reliable.

This is achieved as claimed in the invention by the second buckle part having at least one counter locking bar which is movable back and forth between a locking position of the counter locking bar and an unlocking position of the counter locking bar.

A basic idea of the present invention, consequently, is to provide at least one counter locking bar on the second buckle part in addition to the at least one locking bar of the first buckle part, the achievement thereof being that in the locking position of the locking bar and of the counter locking bar the two buckle parts are connected together in a particularly fixed manner, that is are able to absorb high tensile forces. In addition, the operational reliability is also increased as a result as for separating the buckle parts from one another both the locking bar and the counter locking bar have to be moved into the respective unlocking position. As a result, inadvertently releasing the two buckle parts from one another is very improbable or completely prevented.

In principle, it is conceivable for the first buckle part also to have a locking face which, in the locking position of the counter locking bar, is engaged behind by said counter locking bar. Particularly preferred embodiments of the invention provide that the counter locking bar has at least one support face and in its locking position blocks the locking bar or at least one of the locking bars in its locking position by way of its support face. In other words, it is consequently provided in the case of said embodiments that, when both the locking bar and the counter locking bar are situated in the respective locking position, the support face of the counter locking bar supports the locking bar such that the locking bar is no longer able to be moved into its unlocking position. In said embodiments, the counter locking bar has then, consequently, to be moved first or at least at the same time as the locking bar from its locking position into its unlocking position so that the locking bar is able to be moved into its unlocking position. The buckle parts are not able to be separated from one another until the locking bar and the counter locking bar are both actuated in a corresponding manner.

To complete the picture, it is pointed out that even if in the claims the locking bar and the counter locking bar are referred to in places only in the singular, the most varied embodiments are conceivable. The first buckle part can have one or even several locking bars, such as, for example, two, four or six locking bars of the type depicted. The same also applies to the second buckle part. This latter can have one or even two or more counter locking bars which operate in the manner depicted or interact with one locking bar or several locking bars of the first buckle part.

The connecting position of the buckle parts refers to the position in which the buckle parts have been moved so far toward one another and/or have been moved into contact with one another in an interlocking manner such that the locking bar is able to be moved into its locking position or automatically assumes the same if it is not stopped from doing so, in particular by means of forces from the outside. The fact that the buckle parts are situated in said connecting position, however, does not yet say anything about the actual position of the locking bar and/or of the counter locking bar. In corresponding exemplary embodiments, both can be situated in the connecting position of the buckle parts both in their locking position and in their unlocking position. However, it is conveniently provided that the locking bar and/or the counter locking bar is or are prestressed and in the connecting position of the buckle parts automatically assumes or assume the, preferably respective, locking position insofar as it or they are not prevented from doing so, in particular by forces acting from the outside.

The locking position of the locking bar is the position in which said locking bar engages behind the locking face of the second buckle part associated therewith. The unlocking position of the locking bar is that position in which the locking bar releases the locking face of the second buckle part. So that the buckle parts are able to be separated from one another, the locking bar or all the locking bars of the first buckle part must consequently be situated in the unlocking position. The locking position of the counter locking bar is that position in which the counter locking bar blocks the locking bar in its locking position or engages behind a corresponding locking face of the first buckle part. The unlocking position of the counter locking bar is in each case the position in which it releases the named parts. Engaging behind the respective buckle part by way of the locking bar and/or the counter locking bar as well as also locking the locking bar in its locking position by means of the support face of the counter locking bar is effected in a convenient manner by means of a corresponding positive locking action. The term engaging behind refers in its most general form also to fixing or fastening.

As a rule, the buckle parts are realized such that one of the buckle parts has a male continuation which projects to the outside, by way of which it engages in or in introduced into a corresponding recess of the other buckle part in the connecting position of the two buckles parts. In this sense, it is usual to speak of a male and a female buckle part. However, mixed forms are also conceivable in the case of the invention where the two buckle parts have corresponding projections and recesses by way of which they then interlock in each case in the connecting position.

In preferred embodiments it is provided that the first buckle part has at least one elastic reset element which prestresses the locking bar in the direction of its locking position. The same also applies conveniently to the second buckle part or the counter locking bar. In this case too it is consequently provided in a convenient manner that the second buckle part has at least one elastic reset element which prestresses the counter locking bar in the direction of its locking position. The reset elements are designed in each case in a convenient manner such that, as soon as the locking bar and/or the counter locking bar are released, they move them back again into the respective locking position by means of their elastic reset forces. The elastic reset elements can be realized in a very varied manner. They can be springs, in particular helical springs, leaf springs or the like, but also bodies of elastomer such as, for example, rubber rings, to name but a few examples. The elastic reset elements can also be incorporated directly into the locking bars and/or the counter locking bars by correspondingly elastically realized regions being present in the respective locking bar and/or counter locking bar or by these being realized in each case in a totally elastic manner. In a convenient manner, the locking bar is mounted so as to be movable, preferably pivotable, in or on a housing of the first buckle part. The counter locking bar, contrary to this, is mounted so as to be movable, preferably displaceable, in or on a housing of the second buckle part. Particularly preferred embodiment forms provide that the counter locking bar is displaceable back and forth between its locking position and its unlocking position, whilst the locking bar, in a convenient manner, is pivotable back and forth between its locking positions and its unlocking position. The locking bar can be, for example, a rigid part per se which is mounted so as to be pivotable about a pivot axis. As an alternative to this and/or also in addition to it, however, it is also conceivable for the locking bar to be a part which is elastically bendable per se, that is, for example, is realized in the form of a spring tongue or has one such spring tongue.

In the connecting position of the buckle parts, both locking bar and counter locking bar should be able to be moved conveniently from their locking position into the respective unlocking position by means of manual actuation from the outside. To this end, preferred embodiment forms of the invention provide that a housing of the buckle, preferably of the second buckle part, has at least one, preferably common, engagement opening which is accessible from the outside and the locking bar and/or the counter locking bar, preferably in each case, has or have at least one actuating face, wherein the actuating face or the actuating faces is or are manually actuatable from the outside through the engagement opening in the connecting position of the buckle parts and in the locking position of the locking bar and/or of the counter locking bar. In this case, it is conceivable in principle for the locking bars and the counter locking bars or for each locking bar and each counter locking bar to be provided with its own engagement opening. Preferred embodiment forms, however, provide common engagement openings, through which at least one locking bar and in a convenient manner at least one counter locking bar are manually accessible or actuatable at the same time from the outside.

Development forms of the invention are possible where the first buckle part has at least two, preferably at least four, locking bars which are mounted so as to be pivotable in at least two different pivot planes which are preferably normal with respect to one another.

BRIEF DESCRIPTION OF THE DRAWINGS

Further features and details of preferred development forms of the invention are explained by way of the following description of the figures, in which.

DETAILED DESCRIPTION OF THE PREFERRED EMBODIMENTS

Figure 1:
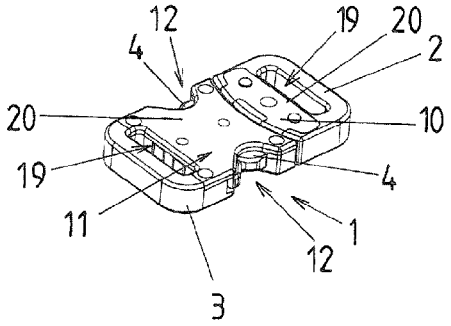
FIGS. 1 to 7 show representations of a first exemplary embodiment as claimed in the invention.
Figure 2:
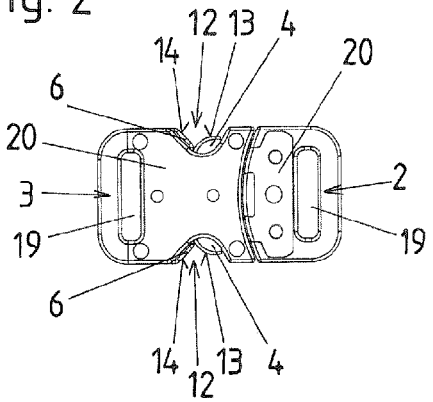
Figure 3:
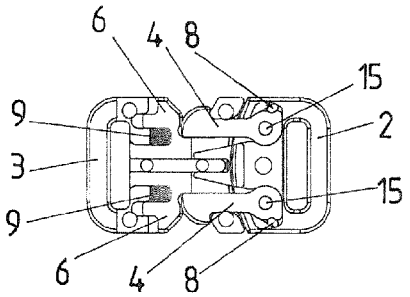
Figure 4:
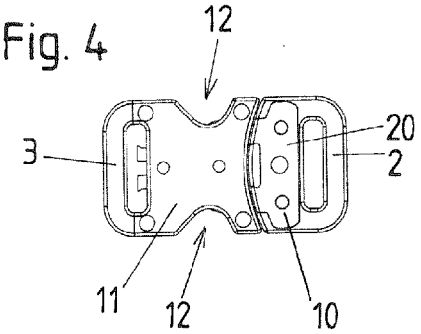
Figure 5:
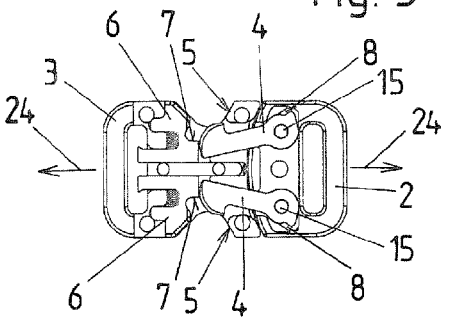

FIG. 1 initially shows a perspective representation of the first exemplary embodiment of a buckle 1. The two buckle parts 2 and 3 are situated in FIG. 1, as also in FIGS. 2 to 5, in their connecting position. FIGS. 2 and 3 show top views where both the locking bars 4 and the counter locking bars 6 are situated in each case in the locking position, as a result of which the buckle parts 2 and 3 are not able to be separated from one another. In FIG. 3, the top plate 20 of the housing 11 of the second buckle part 3 has been removed so that the position of the locking bars 4 and counter locking bars 6 in the interior are better able to be seen. In FIGS. 4 and 5 both the locking bars 4 and the counter locking bars 6 are situated in the respective unlocking position. By pulling in the pulling directions 24, in said positions of the locking bars 4 and counter locking bars 6, the two buckle parts 2 and 3 are able to be pulled apart and consequently separated from one another.

In the case of said exemplary embodiment, the housing 10 of the first buckle part 2 and the housing 11 of the second buckle part 3 as also the locking bars 4 and the counter locking bars 6 consist in a preferred manner of metal, such as, for example, aluminum or steel, or metal alloys. This does not naturally have to be so; the named parts can also be formed at least in part of plastics material or of other suitable materials.

In the first exemplary embodiment according to FIGS. 1 to 7 as also in the other two exemplary embodiments, each buckle part has a belt receiving means 19, through which a respective belt can be pulled for fastening on the respective buckle part. The simplest form of belt receiving means 19 is shown in the variants illustrated. The belt receiving means 19 can naturally have other development forms as are known per se in the prior art. For example, it is conceivable for the belt receiving means 19, as is known per se, to be realized such that they allow the belt to be secured or clamped in different positions and consequently also allow the belt to be adjusted. To this end, it is, for example, conceivable to provide an additional central web, which is displaceable parallel to the pulling directions 24 shown in FIG. 5, in the respective belt receiving means opening 19 around which a corresponding belt can be threaded and clamped by corresponding tension in the belt receiving means 19.

The method of operation of the buckle 1 as claimed in the first exemplary embodiment can best be explained by way of FIGS. 3 and 5. As already stated, the two buckle parts 2 and 3 are situated in both representations in their connecting position in which they are pushed into one another completely. In FIG. 3 both the locking bars 4 and the counter locking bars 6 are situated in the respective locking position. In FIG. 5, the locking bars 4 and the counter locking bars 6 are situated in the respective unlocking position in which the buckle parts 2 and 3 are able to be separated from one another by being pulled apart in the pulling direction 24.

In the exemplary embodiment shown, the locking bars 4 of the first buckle part are rigid parts per se which can be pivoted back and forth about their pivot axis 15 between the locking position and the unlocking position. An elastic reset element 8, which is realized in the form of a rubber ring, prestresses the two locking bars 4 of the first buckle part 2 in the direction of their locking position according to FIG. 3. The achievement as a result, consequently, is that when the locking bars 4 are not pressed into their unlocking position by means of the corresponding expenditure of force, the elastic reset element 8 moves them in the direction of the locking position or holds them there. The two locking bars 4 are pivotable in one pivot plane 16. Said pivot plane 16 coincides in the representations according to FIGS. 3 and 5 with the page plane. The pivot axes 15 are located normally on said pivot plane 16.

In the locking position shown in FIG. 3, each locking bar 4 engages behind a locking face 5 on the second buckle part 3 in a positive locking manner such that the buckle parts 2 and 3 are not able to be pulled apart in the pulling direction 24 and consequently neither are they able to be separated from one another.

As claimed in the invention, at least one counter locking bar 6 is now provided in addition to the locking bars 4. There are two counter locking bars 6 in said exemplary embodiment.

These counter locking bars 6 are situated in the housing 11 of the second buckle part 3. They are mounted in the housing 11 of the second buckle part 3 so as to be displaceable back and forth parallel to the pulling directions 24. The elastic reset elements 9, in this case in the form of helical springs, prestress the counter locking bars 6 in the direction of their locking position shown in FIG. 3. The elastic reset elements 9 therefore press the counter locking bars 6 into their locking position when this is not prevented by corresponding pressure on the actuating faces 14 of the respective counter locking bars 6 from the outside. In the exemplary embodiment shown, in each case the counter locking bars 6 have a support face 7. In the locking position according to FIG. 3, the counter locking bars 6, in each case by way of their support faces 7, support one of the locking bars 4 in such a manner that the respective locking bar 4 is blocked in its locking position and is not able to be moved into its unlocking position. FIG. 3 shows said locking or blocking of the locking bars 4. In FIG. 5, as stated, the locking bars 4 and the counter locking bars 6 are situated in the respective unlocking position. In this position, the locking bar 4 is no longer supported or blocked by the respective support faces 7 of the counter locking bars 6.

In order to move from the situation according to FIG. 3 to the situation according to FIG. 5, the counter locking bars 6, and once they have been released also the locking bars 4 have consequently to be pressed against the force of the respective elastic reset elements 8 and 9 into the respective unlocking positions. This can be effected in the case of the exemplary embodiment of the buckle 1 shown according to FIGS. 1 to 7 as also in the case of the other exemplary embodiments by pressing onto the respective actuating faces 13 and 14 of the locking bars 4 and of the counter locking bars 6. So that said actuating faces 13 and 14 are easily accessible from the outside, they are arranged in the exemplary embodiment shown in each case in pairs in an engagement opening 12 of the second buckle part 3. This allows for a two-finger actuation by the actuating faces 13 and 14 being actuated in each engagement opening 12 by means of one finger in each case. Actuation of each of the actuating faces 13 and 14 can consequently be effected simultaneously by means of a single finger.

As an alternative to this, it would naturally also be conceivable to provide each actuating face 13 and/or 14 with its own engagement opening 12. Then, however, more fingers would be needed to unlock the counter locking bars 6 and the locking bars 4.

Figure 6:
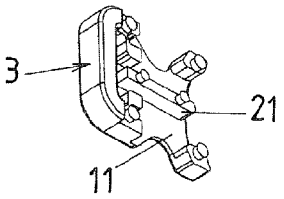
Figure 7:
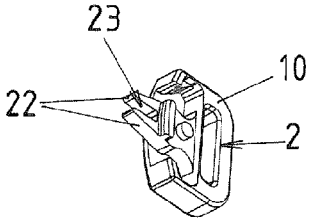
Figure 8:
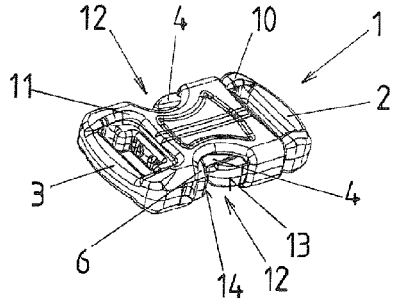
FIGS. 8 to 14 show representations of a second exemplary embodiment as claimed in the invention.

FIGS. 6 and 7 show the first buckle part 2 and the second buckle part 3 in a position separated from one another, the locking bars 4 and the counter locking bars 6 as well as the respective cover plates 20 of the housings 10 and 11, however, having been removed. The continuations 22 with the central recess 23 of the first buckle part 2 and the corresponding central web 21 of the second buckle part 3 can be seen separated from one another in said representation. Through cooperation between the central web 21 and the continuations 22 or their central recess 23, the two buckle parts 2 are centered with respect to one another when they are fitted together.

In the case of the first exemplary embodiment, the first buckle part 2 is the male buckle part, whilst the second buckle part 3 is the female buckle part of said buckle 1.

Figure 9:
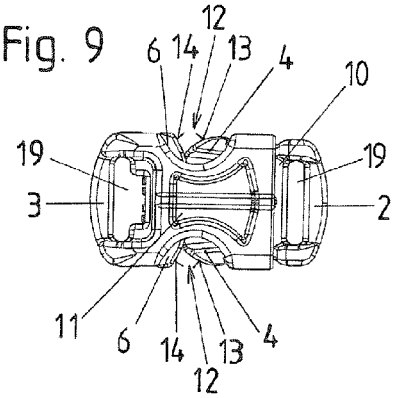
Figure 10:
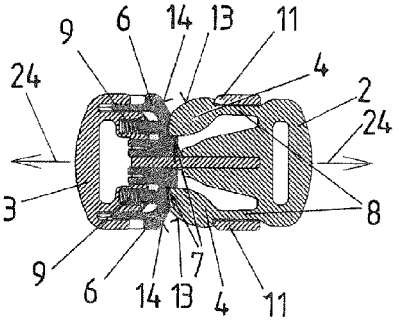
Figure 11:
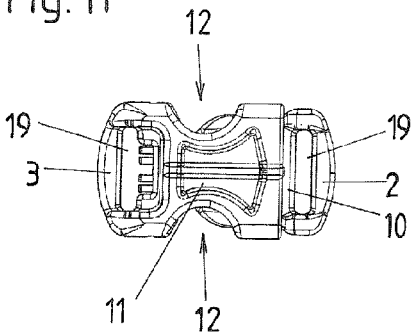
Figure 12:
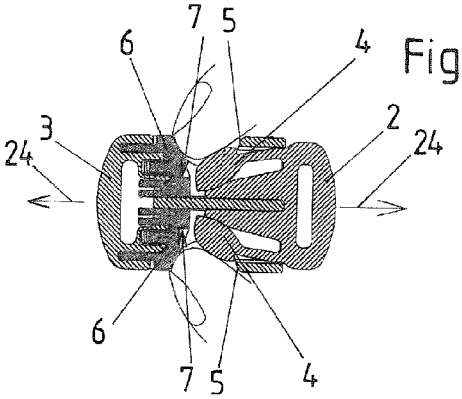
Figure 13:
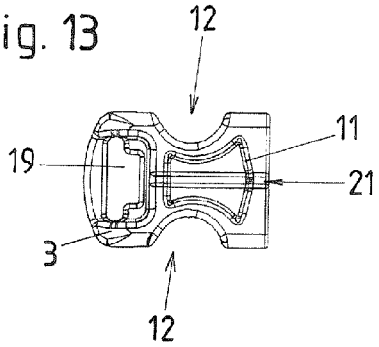
Figure 14:
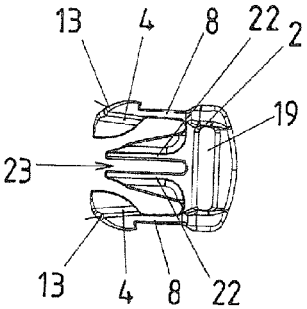
Figure 15:
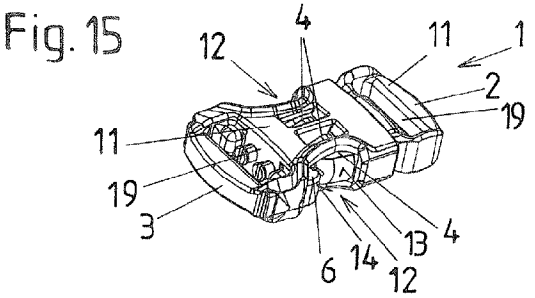
FIGS. 15 to 25 show representations of a third exemplary embodiment as claimed in the invention.

The second exemplary embodiment of the invention according to FIGS. 8 to 14 deals with a buckle 1 where preferably both the first buckle part 2, the second buckle part 3, the locking bars 4 and the counter locking bars 6 consist of plastics material. Naturally this does not have to be necessarily so. The named parts can naturally also have metal, metal alloys or other materials or can be formed thereof. The representations shown in FIGS. 8 to 14 are selected analogously to the presentations of FIGS. 1 to 7. FIGS. 8 to 12 shows the two buckle parts 2 and 3 in each case in the connecting position. In FIGS. 9 and 10 the locking bars 4 and the counter locking bars 6 are situated in the respective locking position. In FIGS. 11 and 12 the locking bars 4 and the counter locking bars 6 are situated in each case in the unlocking position. FIGS. 9 and 11 show top views of the buckle 1, FIGS. 10 and 12 show longitudinal sections in which the inside parts, that is in particular the locking bars 4 and the counter locking bars 6, can easily be seen. FIGS. 13 and 14 show top views in each case of the first buckle part 2 and of the second buckle part 3 separated from one another.

The method of operation of the buckle 1 as claimed in the second exemplary embodiment corresponds in its essential basic features to the method of operation of the buckle 1 of the first exemplary embodiment such that only the differences are looked at below. The essential difference between the second exemplary embodiment and the first exemplary embodiment is that, as can be seen in particular in FIGS. 10 and 12, the locking bars 4 are bendable parts per se. They have in each case web-like portions which act as elastic reset elements 8. In the exemplary embodiment shown according to FIGS. 8 to 14, the first buckle part 2 is an integrally formed part, preferably from plastics materials, where the locking bars 4 are integrally molded on the housing 10. The locking bars 4 are consequently realized at least in regions in the manner of a bending joint. The pivot plane 16, in which they can be pivoted, coincides in turn with the page plane according to FIGS. 10 and 12.

FIG. 12 also shows a schematic representation of two fingers which, by pressing on the respective actuating faces 13 and 14, have moved the locking bars 4 and the counter locking bars 6 into their respective unlocking position.

The third exemplary embodiment as claimed in the invention according to FIGS. 15 to 25 is also realized in a convenient manner as a plastic buckle. In a preferred manner, consequently, both the first buckle part 2, the second buckle part 3 and the locking bars 4 and the counter locking bars 6 are produced from plastics material. However, also in the case of said exemplary embodiment, naturally this does not necessarily have to be so. Other materials such as, for example, suitable metals, metal alloys, etc., can also be used in order to realize this type of buckle 1.

Figure 22:
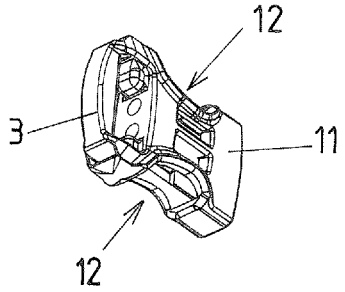
Figure 23:
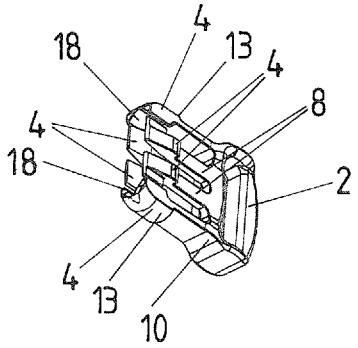
Figure 24:
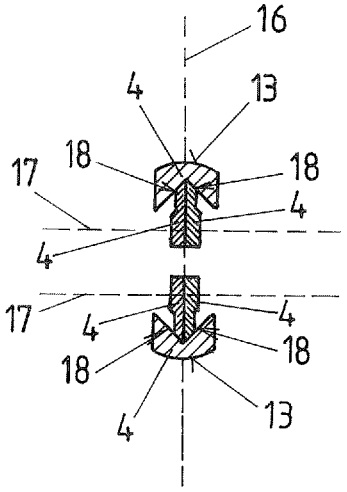

The essential difference between the second exemplary embodiment according to FIGS. 8 to 14 and the third exemplary embodiment according to FIGS. 15 to 25 is that there are not just two locking bars 4 which are pivotable in a common pivot plane 16 provided on the first buckle part 2 but a total of 6 locking bars 4 which, over and above this, are able to be pivoted not in one single pivot plane 16 but in two pivot planes 16 and 17, which, in this case, are located orthogonally with respect to one another, as shown in FIG. 24.

Figure 16:
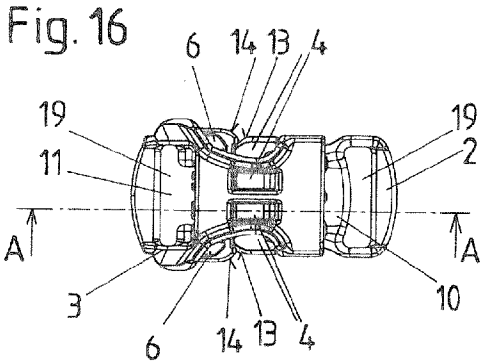
Figure 17:
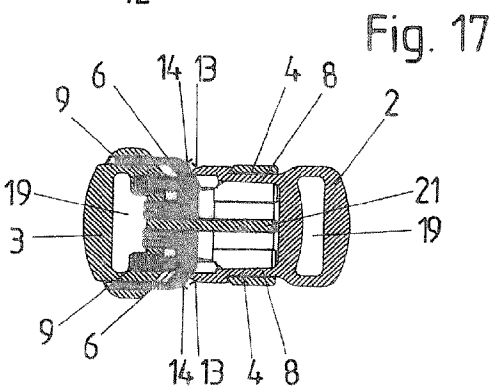
Figure 18:
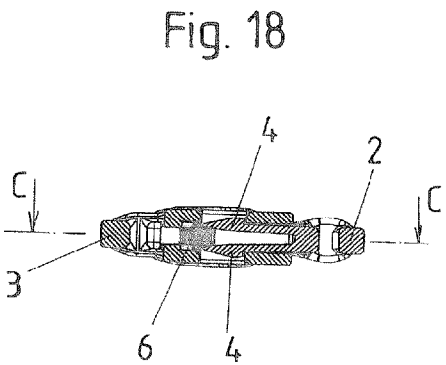
Figure 19:
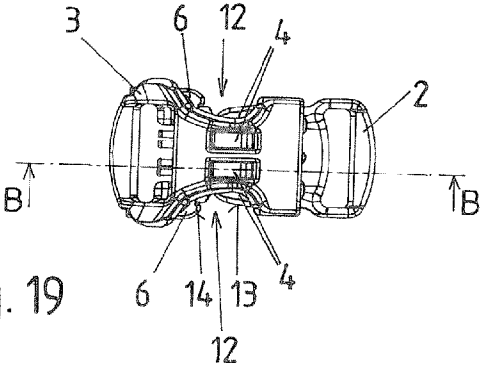
Figure 20:
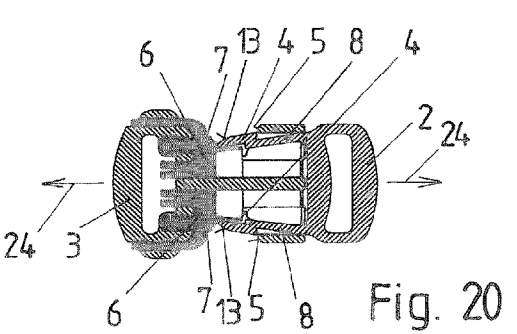
Figure 21:
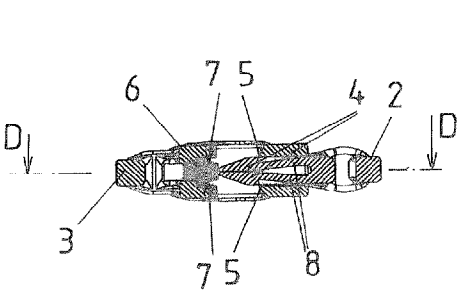

FIGS. 15 to 21, in turn, show the two buckle parts 2 and 3 of said buckle 1 in the connecting position. In FIGS. 16 to 18 the locking bars 4 and the counter locking bars 6 are situated in the respective locking position. In FIGS. 19 to 21, the locking bars 4 and the counter locking bars 6 are shown in the respective unlocking position. For transferring from the locking position into the unlocking position, as also in the second exemplary embodiment and in the first exemplary embodiment, the actuating faces 13 and 14, arranged together in the respective engagement opening 12, also have to be pressed on in each case from the outside by way of a finger.

FIGS. 16 and 19 each show top views, FIGS. 17 and 20 each show longitudinal sections and FIGS. 18 and 21 each show longitudinal sections in sectional planes which are orthogonal with respect to FIGS. 17 and 20. The sectional planes AA and BB, along which the representations according to FIGS. 18 and 21 are sectioned, are shown in FIGS. 16 and 19. The sectional plane CC of FIG. 17 is shown in FIG. 18. The sectional plane DD of FIG. 20 is shown in FIG. 21.

The elastic reset elements 8 of the first buckle part 2 are realized for each locking bar 4 as spiral springs as in the case of the second exemplary embodiment. All the locking bars 4 are consequently parts which are elastically bendable per se at least in regions. The locking bars 4, which can be seen particularly well in FIGS. 17 and 20 and are also manually actuatable by means of engagement in the engagement opening 12, are pivotable in the pivot plane 16. The other four locking bars 4, which can be seen particularly well in FIGS. 18 and 21, are pivotable in the respective pivot planes 17.

The counter locking bars 6, which are displaceable into their unlocking position against the elastic rest elements 9, block all six locking bars 4 in their locking position according to FIGS. 17 and 18. The support faces 7 used for this purpose can be seen particularly well in FIGS. 20 and 21. The type of blocking of the locking bars 4 by means of the counter locking bars 6 in the respective locking position is shown in FIGS. 17 and 18.

So that the buckle parts 2 and 3 are able to be separated from one another by being pulled apart in the pulling direction 24, the counter locking bars 6 have to be moved into their unlocking position so that the locking bars 4 of the first buckle part 2 are also able to be pressed into their unlocking position. In order to press the locking bars 4 into their unlocking position, it is sufficient to actuate the two locking bars 4, visible particularly well in FIGS. 17 and 20, by means of their actuating faces 13. As a result, they are pivoted into the unlocking position shown in FIG. 20. In the case of said pivoting movement into the unlocking position, by means of the transferring faces 18, as can be seen in particular in FIGS. 23 and 24 but also are particularly easy to see in FIGS. 18 and 21, they press the locking bars 4 into the unlocking position according to FIG. 21. Said interaction between the locking bars 4 which are pivotable in the pivot plane 16 and the locking bars 4 which are pivotable in the pivot planes 17 can be seen particularly well in FIG. 24. It can also be seen particularly well from said figure that in a convenient manner the transferring faces 18 are a question of interaction between inclined faces such that a pressing together of the outer locking bars 4 by means of their actuating faces 13 parallel to the pivot plane 16 leads to a pressing together of the other locking bars 4 in the direction parallel to their pivot planes 17. To complete the picture, it is pointed out again that the pivot plane 16 coincides with the page planes of FIGS. 17 and 20 and the pivot planes 17 coincide with the page planes according to FIGS. 18 and 21 or with planes parallel thereto.

In the case of the third exemplary embodiment of the invention shown as an example in FIGS. 15 to 25, it is consequently provided that at least one locking bar 4, which is pivotable in a first of the pivot planes 16, has a transferring face 18 and by means of pivoting said first locking bar 4 from its locking position into its unlocking position and by means of the transferring face 18 at least one second locking bar 4, which is pivotable in a second of the pivot planes 17, is pivotable from its locking position into its unlocking position.

Figure 25:
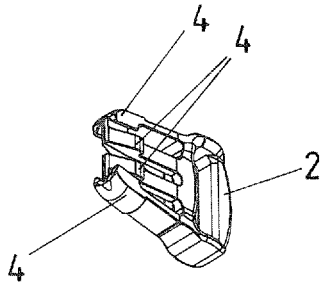

FIGS. 22 and 23 show the two buckle parts 2 and 3 once again in the state separated from one another. In FIG. 23 the locking bars 4 are situated in a position which corresponds to the respective locking position when the two parts 2 and 3 are in the connecting position. In FIG. 25 the locking bars 4 are pressed together into their respective unlocking position.

KEY TO THE REFERENCE NUMERALS

1 Buckle
2 First buckle part
3 Second buckle part
4 Locking bar
5 Locking face
6 Counter locking bar
7 Support face
8 Elastic reset element
9 Elastic reset element
10 Housing
11 Housing
12 Engagement opening
13 Actuating face
14 Actuating face
15 Pivot axis
16 Pivot plane
17 Pivot plane
18 Transfer face
19 Belt receiving means
20 Top plate
21 Central web
22 Continuation
23 Central recess
24 Pulling direction

The invention claimed is:

1. A buckle comprising: a first buckle part and at least one second buckle part, the first buckle part has at least one locking bar which is movable back and forth between a locking position of the locking bar and an unlocking position of the locking bar, in a connecting position of the buckle parts, the locking bar, in the locking position, engages behind a locking face of the second buckle part for locking the two buckle parts together and the locking bar is movable into the unlocking position thereof for separating the buckle parts, the second buckle part has at least one counter locking bar which is movable back and forth between a locking position of the counter locking bar and an unlocking position of the counter locking bar, a housing of the buckle has at least one engagement opening which is accessible from outside, and the locking bar and the counter locking bar in each case have at least one actuating face, and the actuating faces are manually actuatable from the outside through the engagement opening in the connecting position of the buckle parts and in the locking positions of the locking bar and of the counter locking bar.

2. The buckle as claimed in claim 1, wherein the counter locking bar has at least one support face that in the locking position thereof blocks the locking bar or at least one of the locking bars in the locking position of the locking bar by way of said support face.

3. The buckle as claimed in claim 1, wherein the first buckle part has at least one elastic reset element which prestresses the locking bar in a direction of the locking position of the locking bar or the second buckle part has at least one elastic reset element which prestresses the counter locking bar in a direction of the locking position thereof or the elastic reset elements are provided for both the locking bar and the counter locking bar to prestress the locking bar and the counter locking bar into the respective locking positions.

4. The buckle as claimed in claim 1, wherein at least one of the locking bar is mounted so as to be movable in or on a housing of the first buckle part or the counter locking bar is mounted so as to be movable in or on a housing of the second buckle part.

5. The buckle as claimed in claim 1, wherein the counter locking bar is displaceable back and forth between the locking position and the unlocking position thereof.

6. The buckle as claimed in claim 1, wherein the locking bar is pivotable back and forth between the locking position and the unlocking position thereof.

7. The buckle as claimed in claim 1, wherein the locking bar is a rigid part which is mounted so as to be pivotable about a pivot axis or in that the locking bar is a part which is elastically bendable.

8. The buckle as claimed in claim 1, wherein the first buckle part has at least two locking bars which are mounted so as to be pivotable in at least two different pivot planes.

9. The buckle as claimed in claim 8, wherein the two different pivot planes are normal to one another.

10. A buckle comprising: a first buckle part and at least one second buckle part, the first buckle part has at least one locking bar which is movable back and forth between a locking position of the locking bar and an unlocking position of the locking bar, in a connecting position of the buckle parts the locking bar, in the locking position, engages behind a locking face of the second buckle part for locking the two buckle parts together and the locking bar is movable into the unlocking position thereof for separating the buckle parts, the second buckle part has at least one counter locking bar which is movable back and forth between a locking position of the counter locking bar and an unlocking position of the counter locking bar, the first buckle part has at least two locking bars which are mounted so as to be pivotable in at least two different pivot planes, wherein the at least one locking bar, which is pivotable in a first of the pivot planes, has a transfer face and by pivoting said first locking bar is pivotable from the locking position into the unlocking position thereof and by the transfer face at least a second one of the locking bar, which is pivotable in a second of the pivot planes, is pivotable from a locking position into an unlocking position thereof.

* * * * *